United States Patent [19]

Jacobson et al.

[11] 4,238,883

[45] Dec. 16, 1980

[54] SCRAPER ASSEMBLY WITH BLADE LOCK MEANS

[75] Inventors: Chester F. Jacobson, Southboro; Norman D. Poisson, Andover, both of Mass.

[73] Assignee: The Gillette Company, Boston, Mass.

[21] Appl. No.: 49,038

[22] Filed: Jun. 15, 1979

Related U.S. Application Data

[63] Continuation-in-part of Ser. No. 894,596, Apr. 7, 1978, Pat. No. 4,182,033.

[51] Int. Cl.[3] ..... B26B 5/00

[52] U.S. Cl. ..... 30/162; 30/169

[58] Field of Search ..... 30/151, 162, 169, 335, 30/125, 339; 221/102

[56] References Cited

U.S. PATENT DOCUMENTS

| | | | |
|---|---|---|---|
| 3,608,195 | 9/1971 | Levin | 30/162 |
| 3,672,054 | 6/1972 | Kaufman | 30/339 |
| 4,071,952 | 2/1978 | Meshulam | 30/151 |

*Primary Examiner*—Jimmy C. Peters

*Attorney, Agent, or Firm*—Richard A. Wise; Scott R. Foster

[57] ABSTRACT

A scraper assembly comprising a housing having a chamber therein adapted to receive and releasably retain blade units, the housing having a head portion adapted to receive and retain a first of the blade units, and a cover member adapted to cover the first blade retained by the head portion, the cover member being releasably retained by engagement with the head portion, the cover member being further adapted to cover portions of the housing remote from the head portion, the cover member being releasably retained by engagement with a second portion of the housing, whereby the cover member may be selectively positioned to cover the first blade unit and may be removed therefrom and positioned on the housing at an end remote from the first blade unit to expose the first blade unit for scraping operations, and a lock means, comprising an integral portion of the housing, for locking the first blade unit in the head portion.

5 Claims, 5 Drawing Figures

SCRAPER ASSEMBLY WITH BLADE LOCK MEANS

CROSS REFERENCE TO RELATED APPLICATION

This is a continuation-in-part of application Ser. No. 894,596, filed Apr. 7, 1978 now U.S. Pat. No. 4,182,033, issued Jan. 8, 1980, in the names of Chester F. Jacobson and Norman D. Poisson.

BACKGROUND OF THE INVENTION

1. Field of the Invention

This invention relates to scraper devices, and is directed more particularly to a scraper assembly for use with razor blades.

2. Description of the Prior Art

Scraper devices are generally well known in the art and in basic form include a handle having a blade of some sort attached thereto. A free edge of the blade is brought to bear against a surface sought to be scraped clean, as in the case of removing a sticker or paint from glass, or removing peeling paint from a surface, etc. In instances where the free edge is sharpened, care must be exercised to prevent the edge from inflicting harm to persons and articles which might come in contact with the edge. Some scrapers are adapted to utilize razor blades, which are very useful in providing a good scraping edge but which also present an element of danger in view of the cutting capability of the edge.

In U.S. application Ser. No. 894,596, filed Apr. 7, 1978, in the names of Chester F. Jacobson, et al, and incorporated by reference herein, there is described and shown a scraper assembly comprising a housing having a chamber therein adapted to receive and releasably retain blade units, the housing having a head portion adapted to receive and retain one of the blade units, and a cover means adapted to cover the blade retained by the head portion, the cover means being releasably retained by engagement with the head portion, the cover means being further adapted to cover portions of the housing remote from the head portion, the cover means being releasably retained by engagement with a second portion of the housing, whereby the cover means may be selectively positioned to cover the blade unit and may be removed therefrom and positioned on the housing at an end remote from the blade unit to expose the blade unit for scraping operations, to provide a beneficial safety feature.

A safety problem that sometimes arises in the use of scraper devices of the type above described is the movement out of position of the working blade. Accordingly, it is desirable that facility be provided for locking the working blade in place in the head portion of the assembly.

SUMMARY OF THE INVENTION

It is, therefore, an object of the present invention to provide a scraper assembly including a razor blade as a scraping element, including a cover member for covering the blade when not in use, and in which the cover member may be removed from its blade covering position and be attached to the assembly in a second position where the cover member functions as a grip portion of the assembly, and further including means for locking the blade in its working position.

With the above and other objects in view, as will hereinafter appear, a feature of the present invention is the provision of a scraper assembly comprising a housing having a chamber therein adapted to receive and releasably retain blade units, the housing having a head portion adapted to receive and retain a first of the blade units, and a cover means adapted to cover the first blade retained by the head portion, the cover means being releasably retained by engagement with the head portion, the cover means being further adapted to cover portions of the housing remote from the head portion, the cover means being releasably retained by engagement with a second portion of the housing, whereby the cover means may be selectively positioned to cover the first blade unit and may be removed therefrom and positioned on the housing at an end remote from the first blade unit to expose the first blade unit for scraping operations, and a lock means, comprising an integral part of the housing, for locking the first blade unit in the head portion.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
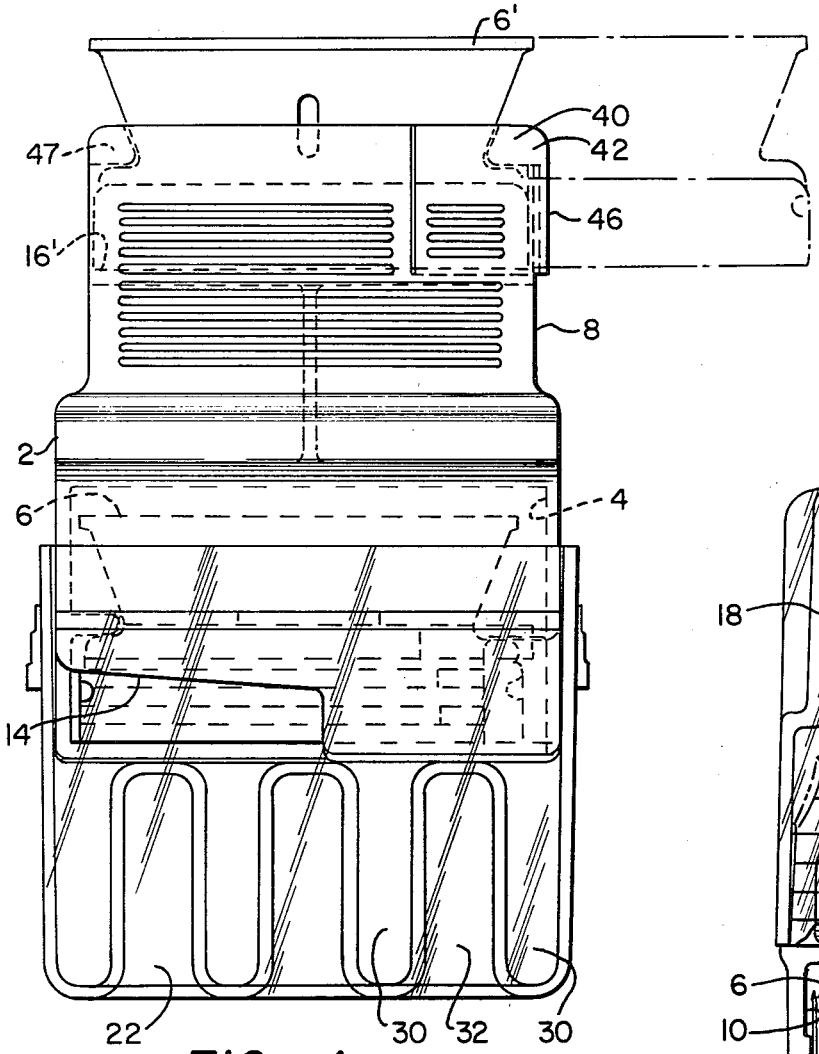
FIG. 1 is a side elevational view of one form of scraper assembly illustrative of an embodiment of the invention, showing the cover member in a first selected position and showing the blade lock portion in a first selected position.

Referring to the drawings, it will be seen that the illustrative embodiment includes a housing 2 having a chamber 4 therein adapted to receive and releasably retain blade units 6. The housing 2 is further provided with a head portion 8 which is adapted to receive and retain a selected one 6' of the blade units 6.

Figure 2:
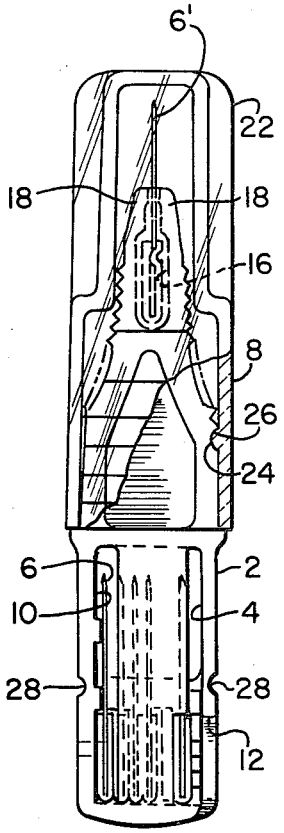
FIG. 2 is an end elevational view of the scraper assembly of FIG. 1, but with the cover member shown in a second selected position.

The housing 2 is provided with first and second openings 10, 12 as best seen in FIG. 2, the opening 10 being for the purpose of removing blades from the chamber 4 and the opening 12 being for the purpose of receiving used blades to be discarded in the chamber 4. The housing 2 is further provided with a slot 14 which enables an operator to press with a thumb or finger upon a blade 6 in the chamber 4 and urge the blade out the opening 10.

The head portion 8 of the housing 2 includes a recess 16 configured and adapted to receive the selected blade unit 6'. The recess 16 is preferably formed by opposed members 18 which have sufficient resiliency to permit the blade unit 6' to be inserted therebetween and exercise a retaining influence on the blade unit.

Figure 3:
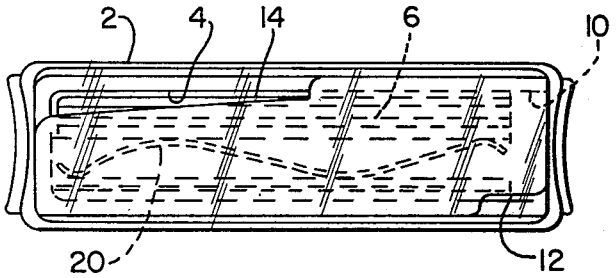
FIG. 3 is a bottom view of the assembly of FIG. 2.

In the chamber 4 there is preferably provided a spring means, which may be in the form of a leaf spring 20 (FIG. 3), which operates to separate the new blades from the used blades, and further operates to bias the blades toward the outside walls of the chamber 4 so as to prevent the blades from falling loosely about in the chamber.

The assembly further includes a cover member 22, which may be used to cover a blade held by the head portion 8, as shown in FIG. 2, or may be removed from the head portion and attached to the housing 2 at the other end thereof, as shown in FIG. 1. To facilitate attachment of the cover member 22 to the housing 2, at either end thereof, the cover member 22 is provided with inwardly directed detents 24 configured to engage a first set of recesses 26 and to engage a second set of recesses 28 (FIG. 2). Preferably, the exterior of the cover member 22 is provided with a series of ribs 30, separated by depressions 32, the arrangment of ribs and depressions providing a gripping means by which the assembly may be gripped by an operator when the cover member is placed in the position shown in FIG. 1.

The head portion 8 of the housing 2 is further provided with an integrally molded lock portion 40, the lock portion 40 comprising a flap 42 connected to the head portion 8 by a hinge portion 44. The flap 42 is preferably provided with a shoulder portion 46 having a recess 48. The shoulder portion 46 is adapted to snap over the end of the blade 6', the end of the blade being received by the recess 48. The flap 42 is further provided with a button portion 49 adapted to override a recessed portion 50 of the blade unit 6' (FIG. 5), and a recess 51 in the opposed member 18. The button portion 49 is preferably provided with a roughened external portion 52 to facilitate manual manipulation.

Figure 4:
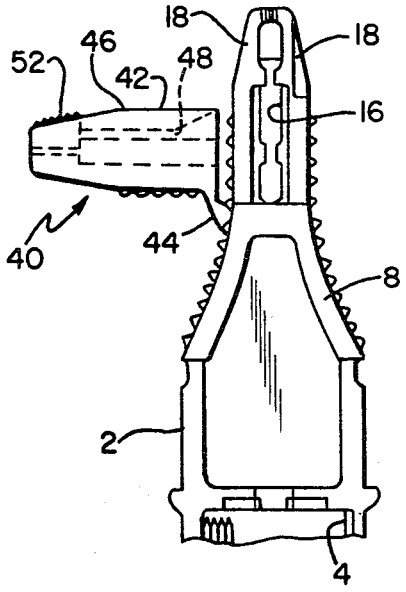
FIG. 4 is a partial elevational view showing the blade lock portion in a second selected position.
Figure 5:
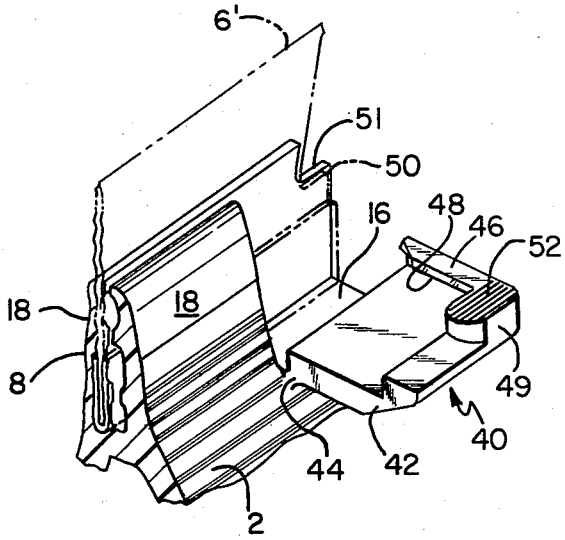
FIG. 5 is an enlarged perspective view of the blade lock portion.

In operation, an operator places the cover member 22 in the position shown in FIG. 1 and opens the lock portion 40, as shown in FIGS. 4 and 5. By insertion of a thumb or finger in the slot 14, a blade 6 is urged out of the opening 10. The operator places the blade in the recess 16 between the member 18. The lock portion 40 is then moved to the closed position, as shown in FIGS. 1 and 2, the shoulder portion 46 overriding the end of the blade, the blade lockingly engaging the recess 48. The assembly is then ready for scraping operations. Upon completion of a scraping operation, the cover member 22 is removed from the recesses 28 and placed in the position shown in FIG. 2 whereby to protect the otherwise exposed edge of the blade 6', by snapping the detents 24 into the recesses 26. In subsequent uses, the cover member 22 may be removed from its edge protecting position and placed in the position shown in FIG. 1 to be used as a gripping means. During use, the shoulder portion 46, along with a second shoulder portion 47 (FIG. 1) molded in the head portion, prevent accidental movement of the blade in the assembly. When it is desired to remove the blade, the lock portion 40 is engaged by the operator and snapped to the open position (FIGS. 4 and 5), permitting removal of the blade unit 6'. The used blade may be inserted through the opening 12 into the chamber 4. The spring means 20 operates to separate the used blades from the unused blades, as well as to retain the blades securely in the chamber.

It is to be understood that the present invention is by no means limited to the particular construction herein disclosed and/or shown in the drawings, but also comprises any modification or equivalents within the scope of the disclosure.

Having thus described our invention what we claim as new and desire to secure by Letters Patent of the United States is:

1. A scraper assembly comprising a housing having two generally parallel elongated sides interconnected by first and second ends and having a head portion adapted to receive and retain a blade unit, and a cover member adapted to cover said blade unit retained by said head portion, said cover member having two generally parallel elongated walls engageable with said sides respectively, and first and second end walls engageable with said ends respectively, said cover member and said head portion being provided with detent and recess means to facilitate engagement of said cover member and said head portion and to facilitate removal of said cover member and said head portion and to facilitate removal of said cover member from said head portion, said cover member being further adapted to cover portions of said housing remote from said head portion, said cover member being releasably retained by engagement with a second portion of said housing and completely separable therefrom, said cover member, when in engagement with said second portion of said housing remote from said blade unit being adapted to serve as a grip portion for said assembly, whereby said cover member may be selectively positioned to cover said blade unit and may be removed therefrom and positioned on said housing remote from said blade unit to expose said blade unit for scraping operations, and may be completely removed from the remainder of said assembly, and lock means for locking said blade unit in said head portion.

2. The invention in accordance with claim 1 in which said lock means comprises a flap connected to said head portion by a hinge portion.

3. The invention in accordance with claim 2 in which said lock means is molded integrally with said hinge portion.

4. The invention in accordance with claim 3 in which said flap is provided with a shoulder portion lockingly engageable with said retained blade unit.

5. The invention in accordance with claim 4 in which said shoulder portion in its locking position engages an end portion of said retained blade unit.

* * * * *